US010619917B2

(12) United States Patent
Brussol et al.

(10) Patent No.: US 10,619,917 B2
(45) Date of Patent: Apr. 14, 2020

(54) MULTI-PRODUCT LIQUEFACTION METHOD AND SYSTEM

(71) Applicant: Air Products and Chemicals, Inc., Allentown, PA (US)

(72) Inventors: Laurent Marc Brussol, Paris (FR); David Joseph Holzer, Suresnes (FR); Sylvain Vovard, Louveciennes (FR); Russell Shnitser, Coopersburg, PA (US); Adam Adrian Brostow, Emmaus, PA (US); Mark Julian Roberts, Kempton, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 155 days.

(21) Appl. No.: 15/703,321

(22) Filed: Sep. 13, 2017

(65) Prior Publication Data

US 2019/0078840 A1 Mar. 14, 2019

(51) Int. Cl.

| | |
|---|---|
| ***F25J 1/00*** | (2006.01) |
| ***F25J 1/02*** | (2006.01) |
| ***F25J 3/06*** | (2006.01) |

(52) U.S. Cl.

CPC ..... *F25J 1/0022* (2013.01); *F25J 1/004* (2013.01); *F25J 1/0047* (2013.01); *F25J 1/0055* (2013.01);

(Continued)

(58) Field of Classification Search

CPC ..... F25J 1/0231; F25J 1/0236; F25J 1/0237; F25J 1/0255; F25J 1/0259; F25J 1/0264;

(Continued)

(56) References Cited

U.S. PATENT DOCUMENTS 3,144,316 A 8/1964 Koehn et al.
3,527,585 A * 9/1970 Ungerleider ..... C10K 3/06 48/127.3

(Continued)

FOREIGN PATENT DOCUMENTS

DE 102015002164 A1 8/2016
EP 0153649 9/1985

(Continued)

OTHER PUBLICATIONS

Krishnamurthy, The Road to Recovery, LNG Industry, reprinted on Jan. 2015, pp. 37-40, [online], [retrieved on Jun. 23, 2017], Retrieved from the Internet <http://www.airproducts.com/~/media/Files/PDF/industries/energy/en-lng-article-the-road-to-recovery.pdf>.

*Primary Examiner* — Edward F Landrum
*Assistant Examiner* — Daniel C Comings
(74) *Attorney, Agent, or Firm* — Amy Carr-Trexler

(57) ABSTRACT

A liquefaction system is capable of sequentially or simultaneously liquefying multiple feed streams of hydrocarbons having different normal bubble points with minimal flash. The liquefying heat exchanger has separate circuits for handling multiple feed streams. The feed stream with the lowest normal boiling point is sub-cooled sufficiently to suppress most of the flash. Feed streams with relatively high normal boiling points are cooled to substantially the same temperature, then blended with bypass streams to maintain each product near its normal bubble point. The system can also liquefy one stream at a time by using a dedicated circuit or by allocating the same feed to multiple circuits.

11 Claims, 6 Drawing Sheets

(52) U.S. Cl.
CPC ..... *F25J 1/0212* (2013.01); *F25J 1/0219* (2013.01); *F25J 1/0236* (2013.01); *F25J 1/0245* (2013.01); *F25J 1/0264* (2013.01); *F25J 1/0291* (2013.01); *F25J 3/061* (2013.01); *F25J 3/064* (2013.01); *F25J 1/0032* (2013.01); *F25J 1/0231* (2013.01); *F25J 1/0237* (2013.01); *F25J 1/0255* (2013.01); *F25J 2210/02* (2013.01); *F25J 2210/04* (2013.01); *F25J 2210/06* (2013.01); *F25J 2215/02* (2013.01); *F25J 2215/62* (2013.01); *F25J 2215/64* (2013.01); *F25J 2220/62* (2013.01); *F25J 2245/02* (2013.01); *F25J 2245/90* (2013.01)

(58) Field of Classification Search
CPC ..... F25J 1/0272; F25J 1/0032; F25J 1/0035; F25J 1/0037; F25J 2210/02
USPC ..... 62/612, 613
See application file for complete search history.

(56) References Cited

U.S. PATENT DOCUMENTS

| | | | | |
|---|---|---|---|---|
| 4,445,917 | A | 5/1984 | Chiu | |
| 4,541,852 | A | 9/1985 | Newton et al. | |
| 4,970,867 | A | 11/1990 | Herron et al. | |
| 5,611,216 | A | 3/1997 | Low et al. | |
| 6,662,589 | B1 | 12/2003 | Roberts et al. | |
| 7,134,296 | B2 * | 11/2006 | Howard | F25J 1/0022 62/613 |
| 9,046,302 | B2 | 6/2015 | Vink et al. | |
| 9,528,758 | B2 | 12/2016 | Nilsen | |
| 2010/0024477 | A1 | 2/2010 | Roberts et al. | |
| 2010/0031699 | A1 | 2/2010 | Dam et al. | |
| 2011/0036121 | A1 | 2/2011 | Roberts et al. | |
| 2012/0240618 | A1 | 9/2012 | Vink et al. | |
| 2015/0285561 | A1 | 10/2015 | Steinbauer et al. | |
| 2016/0097584 | A1 | 4/2016 | Turney | |
| 2016/0097585 | A1 | 4/2016 | Turney | |
| 2016/0097586 | A1 | 4/2016 | Turney et al. | |
| 2016/0097587 | A1 | 4/2016 | Turney et al. | |
| 2016/0097588 | A1 | 4/2016 | Turney et al. | |
| 2016/0097589 | A1 | 4/2016 | Turney et al. | |
| 2017/0038134 | A1 | 2/2017 | Turney et al. | |
| 2017/0307291 | A1 | 10/2017 | Kennedy et al. | |

FOREIGN PATENT DOCUMENTS

| | | |
|---|---|---|
| KR | 20110081497 | 7/2011 |
| WO | 2017067908 | 4/2017 |

* cited by examiner

MULTI-PRODUCT LIQUEFACTION METHOD AND SYSTEM

BACKGROUND OF THE INVENTION

Hydrocarbon liquefaction processes are known in the art. Often, hydrocarbon liquefaction plants are designed to liquefy a specific hydrocarbon or mixture of hydrocarbons at specific feed conditions, for example natural gas or ethane at certain feed temperature, pressure, and composition.

It may be desirable to operate a liquefaction plant using different a feed stream than originally planned. For example, it may be desirable to liquefy ethylene at a plant originally designed to liquefy ethane. There exists therefore, a need for hydrocarbon liquefaction plants that are capable of efficiently liquefying a variety of feed streams.

It is also desirable to provide such flexibility, while also enabling the simultaneous liquefaction of multiple feed streams, each having a different composition, temperature, and/or pressure (hereinafter "different feed properties"). Regardless of the nature of the feed streams, it is also desirable to liquefy the feed streams in a manner that enables each product to be stored in a low-pressure tank (typically less than 2 bara and preferably less than 1.5 bara) and with little or no product flash (preferably less than 10 mole % vapor).

One option for liquefying multiple feed streams, each having different feed properties, and storing each product in a low pressure product tanks with minimum or no flash, would be to require the product streams to leave the main cryogenic heat exchanger (MCHE) at different temperatures. This option is undesirable because it would add complexity to the MCHE, including the addition of side-headers. Another option would be to have the product streams leave MCHE at the same temperature and sub-cool the least-volatile product stream beyond what is required for the storage. This option would require additional power or may lead to collapse of the product tank. In addition, the most volatile product may flash, leading to product loss or the need for re-liquefaction.

Accordingly, there is a need for a hydrocarbon liquefaction plant and process that is capable of liquefying multiple different feed streams with minimal product flash, that is capable of adjusting to changes in the properties of the feed streams, and is simple, reliable, and relatively inexpensive to construct, maintain, and operate.

BRIEF SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Described embodiments, as described below and as defined by the claims which follow, comprise improvements to compression systems used as part of a natural gas liquefaction process. The proposed hydrocarbon liquefaction process and system is capable of sequentially or simultaneously handling multiple feed streams to liquefy such streams having different properties with minimum or no flash (simultaneous operation). The proposed MCHE has separate circuits for handling multiple feed streams. For example, a coil wound heat exchanger (CWHE) has separate circuits to handle different hydrocarbons such as ethane and ethylene. Different streams leave the cold end of the MCHE at substantially the same temperature (i.e., a temperature difference of no more than 5 degrees C.). There are bypass lines connecting warm feeds with the liquefied products. The products are stored as saturated liquid in low-pressure tanks. The most volatile product (i.e., the product with the lowest normal boiling point) is sub-cooled sufficiently to suppress most of the flash, except what is required to get rid of more volatile impurities. Less volatile products (products with relatively high normal boiling points) are cooled to substantially the same temperature, then blended with warm or partially cooled feed streams (referred to as bypass streams) to maintain each product near its bubble point. The system can also liquefy one stream at a time by using a dedicated circuit (with another circuit without any flow), or by allocating the same feed to multiple circuits, with bypass valves open or closed, depending on the required products conditions.

End flash and/or boil-off gas (BOG) can be compressed and recycled to the warm end of the MCHE as another way of controlling product temperature. Such recycling makes the cold end of the MCHE warmer. Recycling may also help maintain product purity or avoid producing end flash vapor product from the liquefaction system. This is particularly desirable when electric motors are used to drive compressors, because the motors have no fuel requirement that can be met by using end flash vapor.

In some embodiments, the product stream temperature of the MCHE may be selected to remove a light contaminant from one of the product streams, rather than cooling to bubble point at storage pressure. Such removal is accomplished by cooling to a warmer product temperature, then flashing the stream in question in its product tank or an end flash drum to remove the contaminant in the resulting vapor. In this case, other products can be warmed to the desired enthalpy by blending with warmer feed gas, while other more volatile products may be handled by recycling the resulting end flash.

For a process in which three products are desired, one optional mode of operation is to recycle the flash gas of the most volatile product, producing the intermediate boiler as saturate liquid (after a pressure reduction), and bypassing the least volatile product.

Described herein are methods for liquefying multiple feed streams of different composition by bypassing a warm feed to achieve a desired temperature and also the use of end flash recycle for more volatile products. Also disclosed is a flexible main exchanger with multiple feed circuits along with means (valves and pipes) for allocating the feed circuits to various different feed sources depending on the desired products.

Several aspects of the systems and methods are outlined below.

Aspect 1: A method for cooling and liquefying at least two feed streams in a coil-wound heat exchanger, the method comprising:

(a) introducing that at least two feed streams into a warm end of the coil-wound heat exchanger, the at least two feed streams comprising a first feed stream having a first normal bubble point and a second feed stream having a second normal bubble point that is lower than the first normal bubble point;

(b) cooling by indirect heat exchange in the coil-wound heat exchanger at least a first portion of each of the first feed stream and the second feed stream against a refrigerant to form at least two cooled feed streams comprising a first cooled feed stream and a second cooled feed stream;

(c) withdrawing the at least two cooled feed streams from a cold end of the coil-would heat exchanger at substantially the same withdrawal temperature;

(d) providing at least two product streams, each of the at least two product streams being downstream from and in fluid flow communication with one of the at least two cooled feed streams, each of the at least two product streams being maintained within a predetermined product stream temperature range of a predetermined product stream temperature, the at least two product streams comprising a first product stream and a second product stream, the predetermined product stream temperature for the first product stream being the first predetermined product stream temperature and the predetermined product stream temperature of the second product stream being the second predetermined product stream temperature;

(e) withdrawing a first bypass stream from the first feed stream upstream from the cold end of the coil-wound heat exchanger; and (f) forming the first product stream by mixing the first cooled feed stream with the first bypass stream, the first predetermined product stream temperature being warmer than the withdrawal temperature of the first cooled feed stream.

Aspect 2: The method of Aspect 1, wherein each of the at least two feed streams comprises a hydrocarbon fluid.

Aspect 3: The method of any of Aspects 1-2, wherein step (e) comprises:

(e) withdrawing a first bypass stream from the first feed stream upstream from the warm end of the coil-wound heat exchanger.

Aspect 4: The method of any of Aspects 1-3, further comprising:

(g) phase separating the second cooled feed stream into a second flash vapor stream and the second product stream, the predetermined product stream temperature of the second product stream being lower than the withdrawal temperature of the second cooled feed stream.

Aspect 5: The method of Aspect 4, further comprising:

(h) compressing and cooling the second flash vapor stream to form a compressed second flash gas stream; and (i) mixing the compressed second flash vapor stream with the second feed stream upstream from the coil-wound heat exchanger.

Aspect 6: The method of Aspect 5, further comprising:

(j) warming the second flash vapor stream by indirect heat exchange against the first bypass stream.

Aspect 7: The method of any of Aspects 1-6, further comprising:

(k) storing the second product stream in a second storage tank at a second storage pressure;

wherein the predetermined product stream temperature of the second product stream is a temperature at which no more than 10 mole % of the second product stream vaporizes at the second storage pressure.

Aspect 8: The method of any of Aspects 1-8, wherein the at least two feed streams further comprise a third feed stream having third volatility that is higher than the first volatility and lower than the second volatility, the at least two cooled feed streams further comprise a third cooled feed stream, the at least two product streams further comprise a third product stream.

Aspect 9: The method of Aspect 8, wherein step (d) further comprises providing the third product stream having a predetermined product stream temperature that is the same as the withdrawal temperature of the third cooled feed stream.

Aspect 10: The method of any of Aspects 1-9, further comprising:

(l) separating impurities from the second feed stream downstream from the second cooled feed stream in a phase separator to produce a second vapor stream containing the impurities and the second product stream.

Aspect 11: The method of any of Aspects 1-10, wherein the predetermined product stream temperature range for each of the at least two product streams is 4 degrees C.

Aspect 12: A method comprising:

(a) providing a coil-wound heat exchanger having a tube side comprising a plurality of cooling circuits;

(b) providing a plurality of feed circuits, each of the plurality of feed circuits being upstream from, and selectively in fluid flow communication with at least one of the plurality of cooling circuits;

(c) providing at least one bypass circuit and a bypass valve for each of the at least one bypass circuit, each of the at least one bypass circuit being operationally configured to enable a portion of a hydrocarbon fluid flowing through one of the plurality of feed circuits to be separated upstream from a cold end of the coil-wound heat exchanger and mixed with that hydrocarbon fluid downstream from the cold end of the coil-wound heat exchanger, the bypass valve for each of the Fat least one bypass circuit being operationally configured to control the fraction of the hydrocarbon fluid that bypasses at least a portion of the coil-wound heat exchanger;

(d) providing a plurality of product circuits, each of the plurality of product circuits being selectively in downstream fluid flow communication with at least one of the plurality of cooling circuits;

(e) supplying a first feed stream combination to the plurality of feed stream conduits, the first feed stream combination comprising at least one hydrocarbon fluid, each of the at least one hydrocarbon fluid having a different volatility from each of the other hydrocarbon fluids of the at least one hydrocarbon fluid;

(f) cooling each of the at least one hydrocarbon fluid of the first feed stream combination in at least one of the plurality of cooling circuits;

(g) withdrawing each of the at least one hydrocarbon fluids of the first feed stream combination from the cold end of the coil-wound heat exchanger at substantially the same cold end temperature into at least one cooled feed circuit;

(h) providing a first product stream of at least one of the at least one hydrocarbon fluid of the first feed stream combination at a product temperature that is different from the cold-end temperature of the at least one cooled feed circuit through which the one of the at least one hydrocarbon flows;

(i) supplying a second feed stream combination to the plurality of feed stream conduits, the second feed stream combination having at least one selected from the group of (1) a different number of hydrocarbon fluids than supplied in step (e), (2) at least one hydrocarbon fluid having a different volatility than any of the hydrocarbon fluids supplied in step (e), and different proportions of each of the at least one hydrocarbon fluid supplied in step (e);

(j) cooling each of the at least one hydrocarbon fluid of the second feed stream combination in at least one of the plurality of cooling circuits;

(k) withdrawing each of the at least one hydrocarbon fluids of the second feed stream combination from the cold end of the coil-wound heat exchanger at substantially the same temperature; and (l) providing a first product stream of at least one of the at least one hydrocarbon fluid of the second feed stream combination at a product temperature that is different from the cold-end temperature of the at least one cooled feed circuit through which the one of the at least one hydrocarbon flows.

Aspect 13: The method of Aspect 12, further comprising:

(m) before beginning step (i), changing a position of a bypass valve for at least one of the bypass circuits.

Aspect 14: The method of any of Aspects 12-13, wherein step (d) further comprises:

(d) providing a plurality of product circuits, each of the plurality of product circuits being selectively in downstream fluid flow communication with at least one of the plurality of cooling circuits and at least one of the plurality of product circuits being in upstream flow communication with a storage tank.

Aspect 15: The method of Aspect 14, further comprising:

(n) storing the at least one of the plurality of product circuits that is in upstream flow communication with a storage tank at a pressure of no more than 1.5 bara and at a temperature that is less than or equal to the bubble point of the hydrocarbon fluid being stored in the storage tank.

Aspect 16: An apparatus comprising:

a coil-wound heat exchanger having a warm end, a cold end, a tube side having a plurality of cooling conduits;

a first feed stream conduit in upstream fluid flow communication with at least one of the plurality of cooling conduits and in downstream fluid flow communication with a supply of a first hydrocarbon fluid having a first normal bubble point;

a second feed stream conduit in upstream fluid flow communication with at least one of the plurality of cooling conduits and in downstream fluid flow communication and second hydrocarbon fluid having a second normal bubble point that is lower than the first normal bubble point;

a first cooled feed stream conduit in downstream fluid flow communication with the first feed stream conduit and at least one of the plurality of cooling conduits;

a second cooled feed stream conduit in downstream fluid flow communication with the second feed stream conduit and at least one of the plurality of cooling conduits;

a first product stream conduit in downstream fluid flow communication with the first cooled feed stream;

a second product stream conduit in downstream fluid flow communication with the second cooled feed stream;

a first bypass conduit having at least one valve, an upstream end in fluid flow communication with the first feed stream upstream from the cold end of the coil-wound heat exchanger or at least one of the plurality of cooling conduits upstream from the cold end, and a downstream end located at an upstream end of the first product conduit and a downstream end of the first cooled feed stream;

wherein the coil-wound heat exchanger is operationally configured to cool the first hydrocarbon fluid and the second hydrocarbon fluid to substantially the same temperature by indirect heat exchange against a refrigerant;

wherein the first bypass conduit is operationally configured to cause the first hydrocarbon fluid flowing through the first product conduit to have a higher temperature than the second hydrocarbon fluid flowing through the second product conduit.

Aspect 17: The apparatus of Aspect 16, further comprising:

a plurality of connecting conduits, each of the connecting conduits having a connecting valve thereon, the plurality of connecting conduits and connecting valves being operationally configured to selective place the first feed stream conduit in fluid flow communication with more than one of the plurality of cooling conduits.

Aspect 18: The apparatus of any of Aspects 16-17, further comprising:

a second phase separator in downstream fluid flow communication with the second product conduit;

a second recycle conduit in fluid flow communication with an upper portion of the second phase separator and the second feed conduit upstream from the coil-wound heat exchanger;

a compressor in fluid flow communication with the second recycle conduit; and a recycle heat exchanger in fluid flow communication with the second recycle conduit and operationally configured to cool a fluid flowing through the second recycle conduit against a fluid flowing through the first bypass conduit.

BRIEF DESCRIPTION OF THE DRAWINGS

Exemplary embodiments will hereinafter be described in conjunction with the appended figures wherein like numerals denote like elements.

DETAILED DESCRIPTION OF INVENTION

Figure 1:
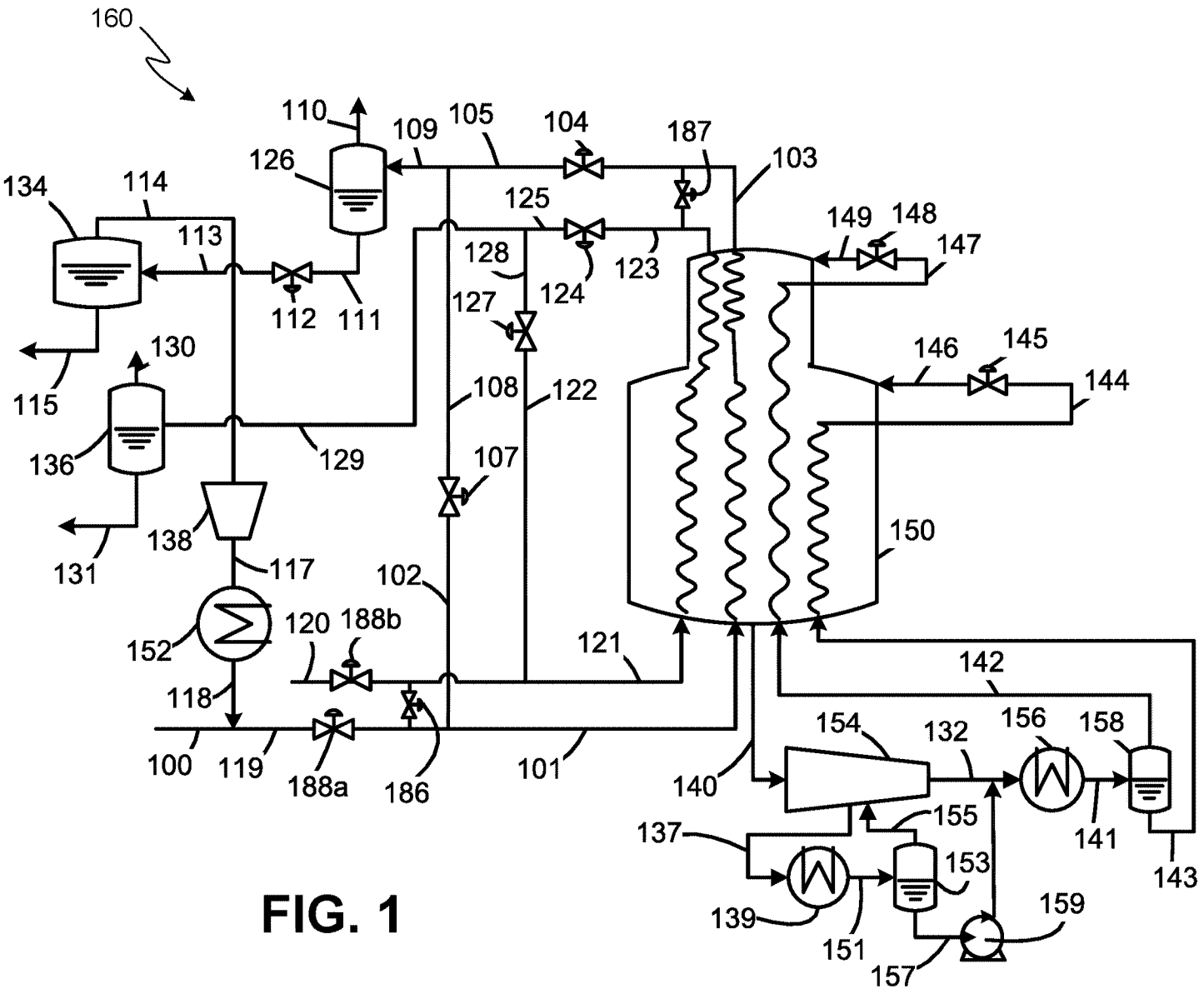
FIG. 1 is a schematic flow diagram of a liquefaction system using a single mixed refrigerant (SMR) process in accordance with a first exemplary embodiment.

The ensuing detailed description provides preferred exemplary embodiments only, and is not intended to limit the scope, applicability, or configuration of the claimed invention. Rather, the ensuing detailed description of the preferred exemplary embodiments will provide those skilled in the art with an enabling description for implementing the preferred exemplary embodiments of the claimed invention. Various changes may be made in the function and arrangement of elements without departing from the spirit and scope of the claimed invention.

Reference numerals that are introduced in the specification in association with a drawing figure may be repeated in one or more subsequent figures without additional description in the specification in order to provide context for other features. In the figures, elements that are similar to those of other embodiments are represented by reference numerals increased by factors of 100. For example, the MCHE 150 associated with the embodiment of FIG. 1 corresponds to the MCHE 550 associated with the embodiment of FIG. 2A. Such elements should be regarded as having the same function and features unless otherwise stated or depicted herein, and the discussion of such elements may therefore not be repeated for multiple embodiments.

In the claims, letters are used to identify claimed steps (e.g. (a), (b), and (c)). These letters are used to aid in referring to the method steps and are not intended to indicate the order in which claimed steps are performed, unless and only to the extent that such order is specifically recited in the claims.

Directional terms may be used in the specification and claims to describe portions of the present invention (e.g., upper, lower, left, right, etc.). These directional terms are merely intended to assist in describing exemplary embodiments, and are not intended to limit the scope of the claimed invention. As used herein, the term "upstream" is intended to mean in a direction that is opposite the direction of flow of a fluid in a conduit from a point of reference. Similarly, the term "downstream" is intended to mean in a direction that is the same as the direction of flow of a fluid in a conduit from a point of reference.

The term "fluid flow communication," as used in the specification and claims, refers to the nature of connectivity between two or more components that enables liquids, vapors, and/or two-phase mixtures to be transported between the components in a controlled fashion (i.e., without leakage) either directly or indirectly. Coupling two or more components such that they are in fluid flow communication with each other can involve any suitable method known in the art, such as with the use of welds, flanged conduits, gaskets, and bolts. Two or more components may also be coupled together via other components of the system that may separate them, for example, valves, gates, or other devices that may selectively restrict or direct fluid flow.

The term "conduit," as used in the specification and claims, refers to one or more structures through which fluids can be transported between two or more components of a system. For example, conduits can include pipes, ducts, passageways, and combinations thereof that transport liquids, vapors, and/or gases. The term "circuit", as used in the specification and claims, refers to a path through which a fluid can flow in a contained manner and may comprise one or more connected conduits, as well as equipment that contains conduits, such as compressors and heat exchangers.

The term "natural gas", as used in the specification and claims, means a hydrocarbon gas mixture consisting primarily of methane.

The terms "hydrocarbon gas" or "hydrocarbon fluid", as used in the specification and claims, means a gas/fluid comprising at least one hydrocarbon and for which hydrocarbons comprise at least 80%, and more preferably at least 90% of the overall composition of the gas/fluid.

The term "liquefaction", as used in the specification and claims, means cooling the fluid in question to a temperature at which at least 50 mole % of the fluid remains liquid when let down to a storage pressure of 1.5 bara or less. Similarly, the term "liquefier" refers to the equipment in which liquefaction takes place. In the context of the liquefaction processes disclosed herein, it is preferable that more than 75 mole % of the fluid remains liquid when let down to the storage pressure used by that process. Typical storage pressures are in the range of 1.05 to 1.2 bara. Feed streams are often supplied at a supercritical pressure and do not undergo a discrete phase transition during the cooling associated with liquefaction.

The term "sub-cooling", as used in the specification and claims, means that the fluid in question is further cooled (beyond what is necessary for liquefaction) so that, when let down to the storage pressure of the system, at least 90 mole % of the fluid remains liquid.

The terms "boiling point" and "boiling temperature" are used interchangeably in the specification and claims and are intended to be synonymous. Similarly, the terms "bubble point" and "bubble temperature" are also used interchangeably in the specification and claims and are intended to be synonymous. As is known in the art, the term "bubble point" is the temperature at which the first bubble of vapor appears in a liquid. The term "boiling point" is the temperature at which the vapor pressure of a liquid is equal to the pressure of the gas above it. The term "bubble point" is typically used in connection with a multi-component fluid in which at least two of the components have different boiling points. The terms "normal boiling point" and "normal bubble point", as used the specification and claims, mean the boiling point and bubble point, respectively, at a pressure of 1 atm.

Unless otherwise state herein, introducing a stream at a location is intended to mean introducing substantially all of the said stream at the location. All streams discussed in the specification and shown in the drawings (typically represented by a line with an arrow showing the overall direction of fluid flow during normal operation) should be understood to be contained within a corresponding conduit. Each conduit should be understood to have at least one inlet and at least one outlet. Further, each piece of equipment should be understood to have at least one inlet and at least one outlet.

The term "essentially water-free", as used in the specification and claims, means that any residual water in the stream in question is present at a sufficiently low concentration to prevent operational problems due to water freeze out in any stream downstream from, and in fluid flow communication with, the stream in question. Typically, this will mean less than 0.1 ppm water.

The term "substantially the same temperature," as used in the specification and claims in relation to temperature differences between cooled feed streams at the cold end of an MCHE, means that no cooled feed stream has a temperature difference of more than 10 degrees C. (preferably, no more than 5 degrees C.) from any other cooled feed stream.

As used herein, the term "compressor" in intended to mean a device having at least one compressor stage contained within a casing and that increases the pressure of a fluid stream.

Described embodiments provide an efficient process for the simultaneous liquefaction of multiple feed gas streams and are particularly applicable for the liquefaction of hydrocarbon gases. Possible hydrocarbon gasses include ethane, ethane-propane mix (E/P Mix), ethylene, propane, and natural gas.

As used in the specification and claims, a temperature range of X degrees is intended to mean a range of X degrees above and below the temperature at issue.

Referring to FIG. 1, a hydrocarbon liquefaction system 160 using an SMR process is shown. It should be noted that any suitable refrigeration cycles could be used, such as propane-precooled mixed refrigerant (C3MR), dual mixed refrigerant (DMR), or reverse-Brayton, such as gaseous nitrogen recycle.

An essentially water-free first feed stream 100, and/or, multiple additional feed streams (one or more) such as the second feed stream 120, are cooled in a MCHE 150. The first feed stream 100 may be combined with a first feed recycle stream 118 to form a combined first feed stream 119. The combined first feed stream 119 may, optionally, be divided into a first MCHE feed stream 101 and a first feed bypass stream 102. The first MCHE feed stream 101 is cooled and liquefied in the MCHE 150 to form a liquefied first product stream 103. The first feed bypass stream 102 may be reduced in pressure in valve 107 to produce a reduced pressure first feed bypass stream 108.

The liquefied first product stream 103 is withdrawn from the MCHE 150 and reduced in pressure though valve 104 to produce a two-phase first product stream 105. The two-phase first product stream 105 may be combined with the reduced pressure first feed bypass stream 108, resulting in a combined two-phase first product stream 109. The combined two-phase first product stream 109 is fed to a first end flash drum 126, in which the combined two-phase first product stream 109 is separated into a first end flash drum vapor stream 110 and a first end flash drum liquid stream 111. The first end flash drum vapor stream 110 may contain impurities.

The first end flash drum liquid stream 111 is further reduced in pressure through valve 112, resulting in a reduced pressure first end flash drum liquid stream 113, which is fed to a first storage tank 134. A final first liquid product stream 115 is extracted from the lower end of the first storage tank 134, and is the final product of the first feed stream 100. The system 160 is operated to deliver the first liquid product stream 115 at temperature that is within a predetermined product temperature range, which is preferably a range of 4 degrees C. (i.e., 4 degrees above or below a set point temperature) and, more preferably, a range of 2 degrees C.

A first storage tank vapor stream 114 may be extracted from an upper end of the first storage tank 134 is compressed in a compressor 138 to create a compressed storage tank first product vapor stream 117, which is cooled to ambient temperature in aftercooler 152 to create the first feed recycle stream 118.

Optionally, a portion of either of the vapor streams (first end flash drum vapor stream 110 or first storage tank vapor stream 114) may also be used as fuel elsewhere in the plant. The compressor 138 may have multiple stages with intercoolers, with fuel withdrawn between stages (not shown).

A second feed stream 120 is divided into the second MCHE feed stream 121 and second feed bypass stream 122. The second MCHE feed stream 121 is cooled and liquefied in the MCHE 150 to form a liquefied second product stream 123. The second feed bypass stream 122 is reduced in pressure in valve 127 to produce a reduced pressure second feed bypass stream 128. The liquefied second product stream 123 is withdrawn from the MCHE 150, reduced in pressure though valve 124, resulting in a two-phase second product stream 125.

The two-phase second product stream 125 is combined with the reduced pressure second feed bypass stream 128 to form a combined two-phase second product stream 129, which is fed into to a second end flash drum 136. The second end flash drum 136 separates the combined two-phase second product stream 129 into a second end flash drum vapor stream 130 and a second end flash drum liquid stream 131. The second end flash drum vapor stream 130 may contain impurities. The second end flash drum liquid stream 131 may be stored in a product tank (not shown).

It should be noted that, depending upon operational conditions, either or both of the bypass streams (the first feed bypass stream 102 and the second feed bypass stream 122) may have a zero flow.

In this embodiment, the system 160 provides two ways to control the product temperature for each feed stream, by adjusting the amount of fluid flowing through the bypass line associated with that stream and adjusting the amount of recycling flash vapor associated with that stream. For example, increasing the fraction of the combined first feed stream 119 that flows through the first feed bypass stream 102 increases results in the combined two-phase first product stream 109 becoming warmer (assuming all other process variables remain constant). Conversely, increasing the flow rate of the first feed recycle stream 118 will result in the cold end of the MCHE 150 being warmer for all streams leaving the cold end of the MCHE 150 (including the liquefied first product stream 103 and the liquefied second product stream 123, or any other liquefied product stream). Although FIG. 1 only shows two feed circuits and two product streams, any number of feed circuits and product streams may be utilized. Further, FIG. 1 shows the refrigeration system including and the compression system. The compression system is part of the systems 560, 660 of FIGS. 2A through 3C, but is omitted in the figures in order to simplify the drawings.

The system 160 provides the ability for flexible, multi-feed stream operation. For example, the MCHE 150 could be operated so that the feed stream having the lowest boiling point is supplied to its storage tank at the bubble point temperature for that feed stream. The liquefied product stream associated with each other feed stream (with a higher boiling point) is warmed by its bypass stream to prevent excessive sub-cooling. Operating the system 160 in this way is particularly useful if feed streams for feeds having relatively high boiling points also have contaminants that require warmer operating temperatures for removal. For example, the second end flash drum vapor stream 130 could be used to remove contaminants from the combined two-phase second product stream 129.

Alternatively, the MCHE 150 could be operated at the bubble point temperature of the highest boiling feed or an intermediate temperature between the highest-boiling feed and the lowest-boiling feed. The latter method of operating would result in a significant flash vapor stream, such the first storage tank vapor stream 114, at the storage tank of a lowest-boiling feed. The first storage tank vapor stream 114 can be used in other parts of the plant or compressed and recycled to the warm end of the MCHE 150 to avoid producing net vapor export stream, as described before and shown on FIG. 1.

In this MCHE 150, at least a portion of, and preferably all of the refrigeration is provided by vaporizing at least a portion of sub-cooled refrigerant streams after pressure reduction across reducing valves.

As noted above, any suitable refrigeration cycle could be used to provide the refrigeration to the MCHE 150. In this exemplary embodiment, a low-pressure gaseous mixed refrigerant (MR) stream 140 is withdrawn from the bottom of the shell-side of the MCHE 150 and is compressed in a compressor 154 to form a high pressure gaseous MR stream 132, which is at a pressure of less than 10 bar. The high pressure gaseous MR stream 133 is cooled in an aftercooler 156 to a temperature at or near ambient temperature to form a high-pressure two-phase MR stream 141.

The high-pressure two-phase MR stream 141 is separated in a phase separator 158 into a high-pressure liquid MR stream 143 and a high-pressure vapor MR stream 142. The high-pressure liquid MR stream 143 is cooled in the warm bundle of the MCHE 150 to form a cooled high-pressure liquid MR stream 144 reduced in pressure across a valve 145 to form a reduced pressure liquid MR stream 146. The reduced pressure liquid MR stream 146 is then introduced to the shell side of the MCHE 150 between the warm and cold bundles to provide refrigeration the pre-cooling and liquefaction step.

The high-pressure vapor MR stream 142 is cooled and liquefied in the warm and cold bundles of the MCHE 150 to produce a liquefied MR stream 147. The liquefied MR stream 147 is reduced in pressure across a valve 148 to produce a reduced pressure liquid MR stream 149, which is introduced into the shell side of the MCHE 150 at the cold end of the MCHE 150 to provide refrigeration in the sub-cooling step.

In this exemplary embodiment, the compressor 154 typically has two stages with an intercooler 137. A medium pressure MR stream 139 is withdrawn after the first compressor stage and is cooled in the intercooler 137 to produce a cooled medium pressure MR stream 151. The cooled medium pressure MR stream 151 then flows through a phase separator 153 and is separated into a medium pressure vapor MR stream 155 and a medium pressure liquid MR stream 157. The pressure of the medium pressure liquid MR stream 157 is then increased by pump 159 before being combined with the high pressure gaseous MR stream 132.

FIGS. 2A and 2B and 3A through 3C are block diagrams showing exemplary multi-feed liquefaction systems. In order to simplify these diagrams, only the MCHE, and feed streams, product streams, storage tanks, bypass conduits, recycle conduits, and associated valves are shown. It should be understood that these systems include compression subsystems and circuits for the refrigerant, as shown in FIG. 1, for example. In FIGS. 2A and 2B and 3A through 3C, valves that are at least partially open (such as valve 588*a* in FIG. 2A) have white fill are filled and valves that are closed have black fill (such as valve 588*b* in FIG. 2A).

Figure 2A:
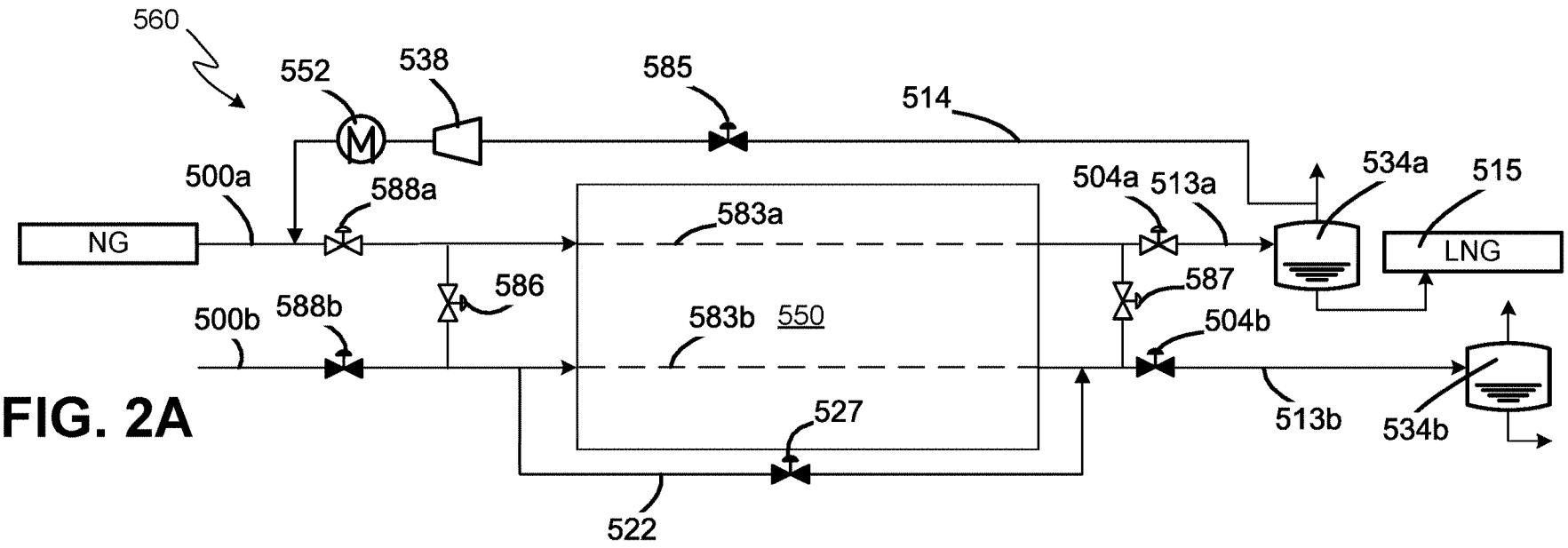
FIG. 2A is a schematic flow diagram showing operation of the liquefaction system of FIG. 1 with a single natural gas feed stream.
Figure 2B:
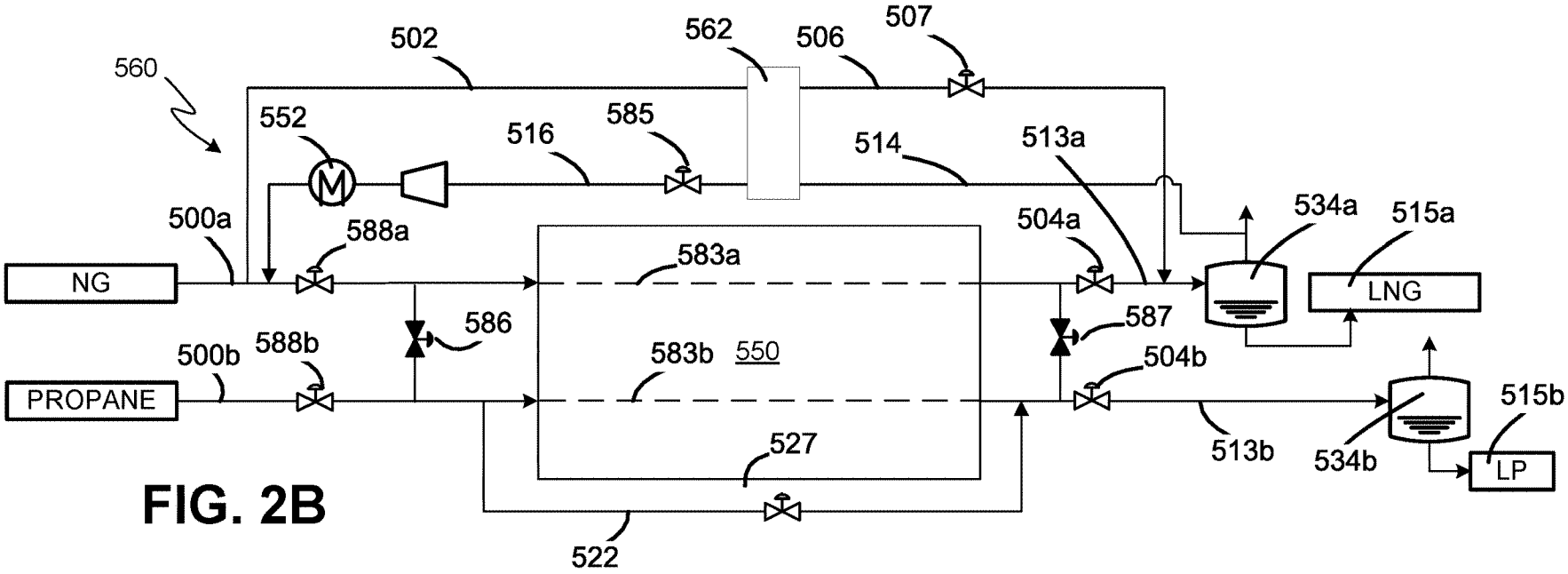
FIG. 2B is a schematic flow diagram showing operation of the liquefaction system of FIG. 1 with a natural gas feed stream and a propane stream.

The system of 560 FIGS. 2A & 2B the MCHE 550 includes two cooling circuits 583*a*, 583*b*. In FIG. 2A, the system 560 is configured to liquefy a single feed stream 500*a* of natural gas. The feed stream 500*a* is fed through both of the hydrocarbon cooling circuits 583*a*, 583*b*. The natural gas exits the cold end of the MCHE 550 at temperature designed to result in the liquefied natural gas being at or near its bubble point in its storage tank 534*a* when stored at a pressure of less than 1.5 bara. No bypass or flash recycle is desirable under these operating conditions. Accordingly, valve 588*b* is closed to prevent backflow into the second feed stream 500*b*. Valve 527 is closed to prevent any flow through the bypass circuit 522 for the second feed stream 500*b*. Valve 585 is closed to prevent and flash gas from the storage tank 534*a* from being recycled. Optionally, valve 504*b* is closed to prevent LNG from entering the second storage tank 534*b*. Valves 586, 587 for connecting conduits are open to allow fluid from the first feed stream 500*a* to flow through both hydrocarbon cooling circuits 583*a*. 583*b*.

In FIG. 2B, the same system 560 is shown, but instead of processing only natural gas, the system 560 is operationally configured to process both natural gas (through feed line F1) and propane (through feed line 500*b*). The system 560 is configured so that the natural gas and propane exit the MCHE 550 at substantially the same temperature, with the exit temperature resulting in the liquefied natural gas being at or near its bubble point in its storage tank 534*a* when stored at a pressure of less than 1.5 bara. Under these operating conditions, natural gas flows through one hydrocarbon cooling circuit 583*a* and propane flows through the other hydrocarbon cooling circuit 583*b*. Valves 586, 587 on the connecting conduits are closed to prevent mixing of the natural gas and propane. Valves 504*a*, 504*b* are open to enable liquefied natural gas and liquefied propane to flow from the cold end of the MCHE 550 into separate storage tanks 534*a*, 534*b*.

In order to enable the propane to be stored at or near its bubble point in its storage tank 534*b* at a pressure of no more than 1.5 bara, a bypass portion of the propane is directed to a bypass circuit 522 and a feed portion of the propane stream flows through the hydrocarbon cooling circuit 583*b*, then the bypass portion is recombined with the feed portion of the propane stream downstream from the cold end of the MCHE 550 and before the propane enters the storage tank 534*b*. A bypass valve 527 is at least partially open to allow flow through the bypass circuit 522. The amount of the propane feed stream that is directed to the bypass circuit 522 is selected to sufficiently warm propane exiting the cold end of the MCHE 550 to a temperature that is at or near the bubble point when stored in the storage tank 534*b* at a pressure of no more than 1.5 bara. Optionally, a portion of any flash gas from the first storage tank 534*a* could be compressed, cooled, and mixed with the natural gas feed 500*a* upstream from the MCHE 550.

The operational configurations shown in FIGS. 2A and 2B and described above enable the system 560 to easily adapt to changes in feed stream composition. In the operational configuration of FIG. 2B, the system 560 is capable of simultaneously liquefying both natural gas and propane, without the complexity and cost associated with cooling tube side streams to different temperatures in the MCHE 550, and while avoiding the risks associated with storing sub-cooled propane at low pressure. The bypass circuit 522 also increases efficiency by reducing the refrigeration load on the cooling circuit 583*b* through which propane flows. Simply by changing the position of valves, the system 560 is capable of switching from processing simultaneous natural gas and propane feeds (FIG. 2B) to processing only natural gas (FIG. 2A) without a significant reduction in efficiency.

FIG. 2B also shows an optional end flash heat exchange, in which an end flash stream 514 from storage tank 534*a* is warmed in a heat exchanger 562 against a portion 502 of the natural gas feed stream 500*a* to produce a warmed end flash stream 516. The portion 502 of the natural gas feed stream 500*a* is at least partially liquefied in the heat exchanger 562 to form an at least partially liquefied stream 506, which is sent to tank 534*a*. Valves 507 and 585 are shown as being open in FIG. 2B to allow flow through the heat exchanger 562. In an alternative embodiment, a portion of the refrigerant stream, such as 141 or 143 or 142 (see FIG. 1) could be cooled against the end flash stream 514 in heat exchanger 562 instead of the portion 502 of the natural gas feed stream 500*a*. Alternatively, the end flash stream 514 may be obtained from an end flash drum instead of the storage tank 534*a*.

Figure 3A:
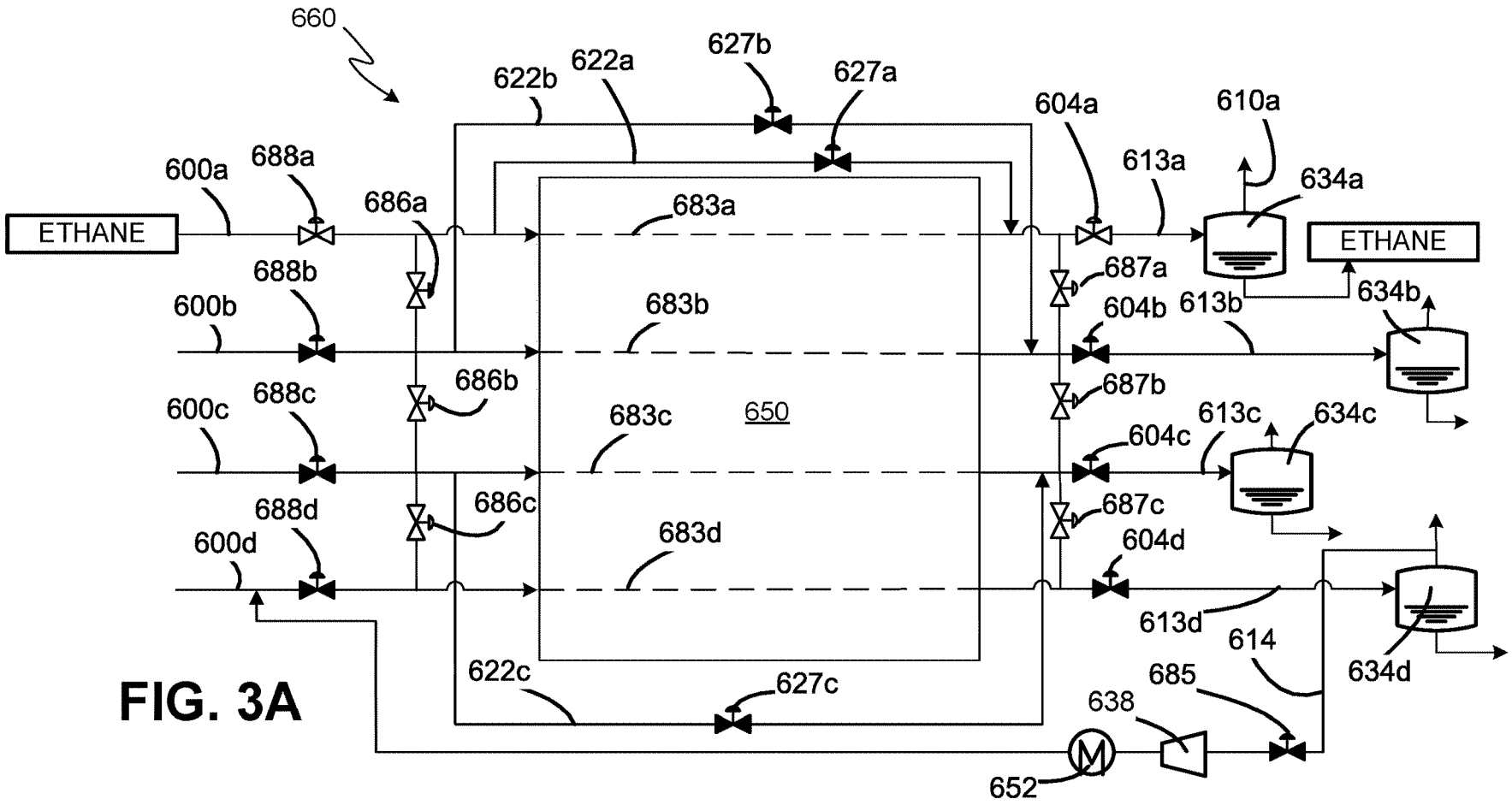
FIG. 3A is a schematic flow diagram showing operation of the liquefaction system of FIG. 1 with a single ethane feed stream.
Figure 3B:
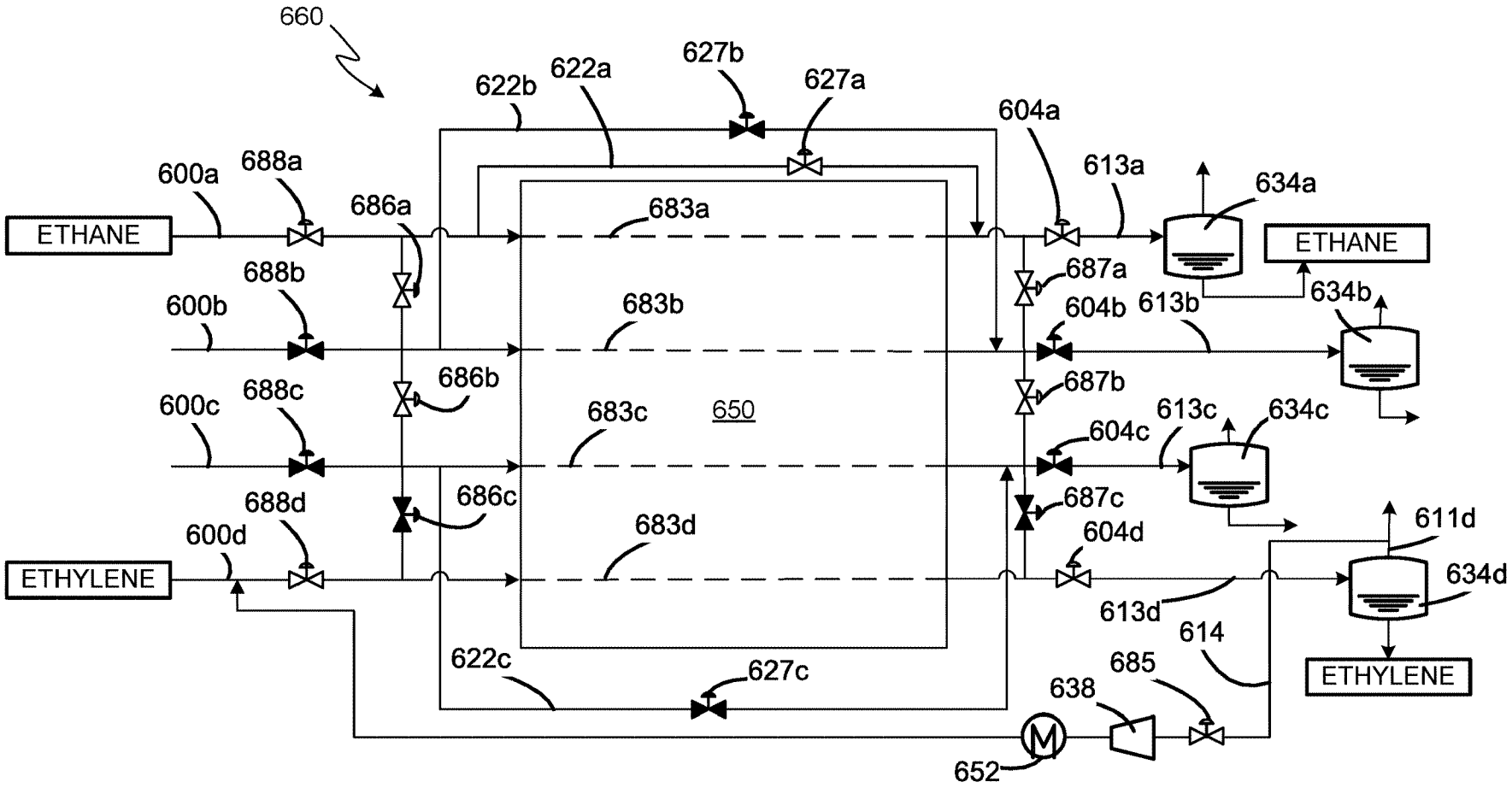
FIG. 3B is a schematic flow diagram showing operation of the liquefaction system of FIG. 1 with ethane and ethylene feed streams.
Figure 3C:
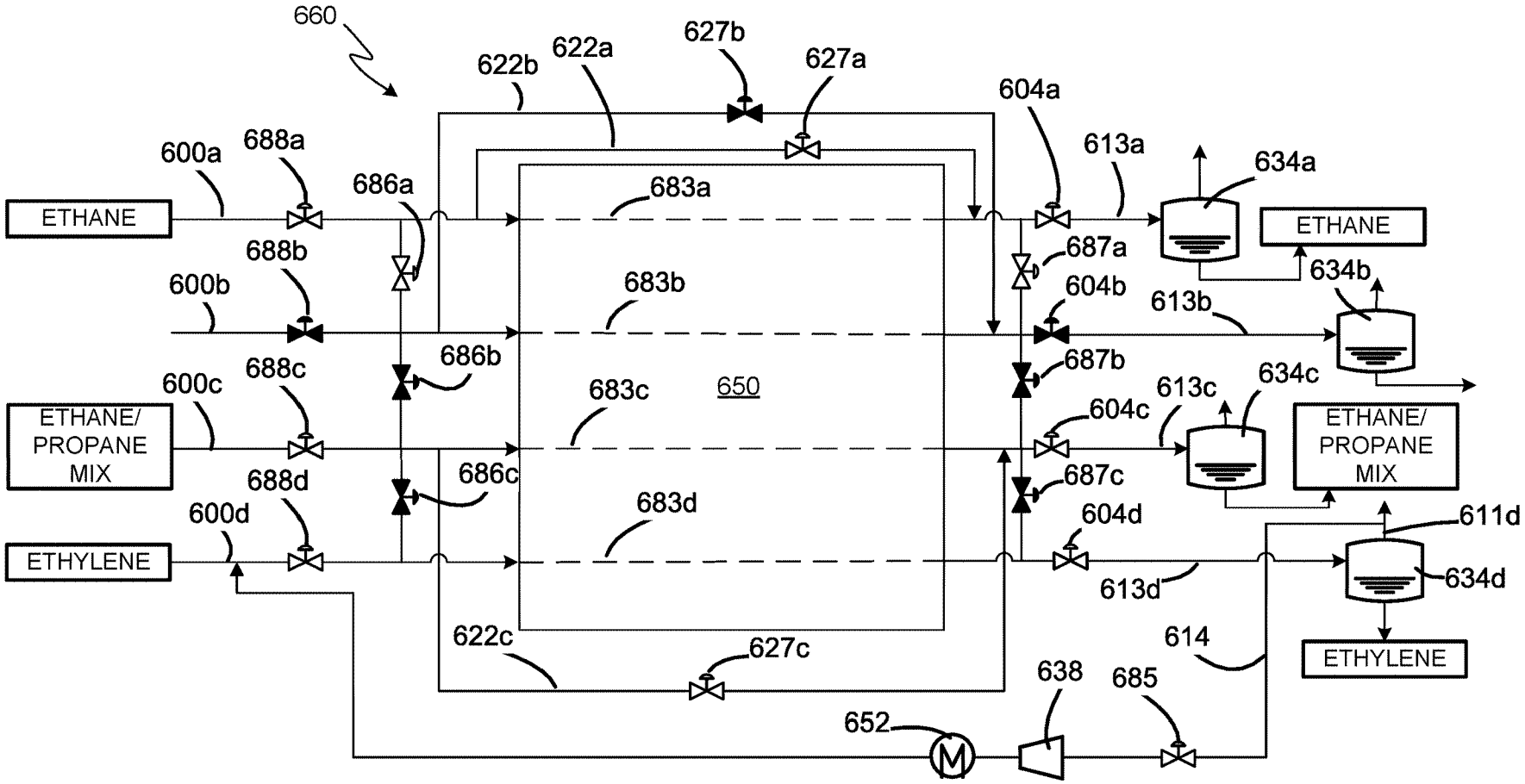
FIG. 3C is a schematic flow diagram of a showing operation of the liquefaction system of FIG. 1 with ethane, ethylene, and ethane/propane mixture feed streams.

In the system 660 of FIGS. 3A, 3B and 3C, the MCHE 650 includes four cooling circuits 683*a*, 683*b*, 683*c*, 683*d*. FIG. 3A shows a single feed mode where ethane is liquefied in the MCHE 650. Valves 688*b*, 688*c*, 688*d* are closed to isolate unused feed circuits 600*b*, 600*c*, 600*d*. Similarly, valves 687*b*, 687*c*, 687*d* are also closed to isolate unused storage tanks 634*b*, 634*c*, 634*d*. Because only one hydrocarbon fluid is being processed, bypass valves 627*a*, 627*b*, 627*c* are closed, as well as the recycle valve 685. At the cold end of the MCHE 650, the ethane feed is preferably at a temperature that will result in the ethane being at its bubble point in the storage tank 634*a*. Optionally, the temperature at the cold end of the MCHE 650 could be set to result in vaporization of impurities through vent/flash stream 610*a*. Alternatively, in the event that the temperature at the cold end of the MCHE 650 was set to liquefy a more volatile product, such as ethylene, cooled ethane could be warmed by the bypass stream 622*a* (meaning that the bypass valve 627*a* would be at least partially open), in order to prevent excessive cooling of the ethane product, which may lead to a collapse of the storage tank 634*a*.

FIG. 3B shows this system 660, operationally configured to process two simultaneous feeds, in this case ethane (feed stream 600*a*) and ethylene (feed stream 600*d*). In this configuration, the ethane feed is being cooled in three of the cooling circuits 683*a*, 683*b*, 683*c*, meaning that connecting valves 686*a*. 686*b*. 686*c* are open. Cooled ethane from each of the cooling circuits 683*a*, 683*b*, 683*c* is then directed to a single product stream 613*a*. In FIG. 3B, one of the bypass circuits 622*a* is open, so that a portion of the warm ethane feed is mixed with cooled ethane downstream from the cold end of the MCHE 650, which is intended to maintain the ethane product stream at a temperature at close to its bubble point in the storage tank 634*a*.

In this exemplary embodiment, the system 660 is operationally configured to produce a temperature at the cold end of the MCHE 650 that is close to the bubble point of ethylene in the storage tank 634*d* to suppress flash. Under these operating conditions, there is no need to recycle ethylene.

Alternatively, the system 660 could be operationally configured to maintain a temperature at the cold end of the MCHE 650 that is warmer than ethylene's bubble point but colder than ethane's bubble point. In this case, a portion of the ethylene flash stream 611*d* is recycled (via recycle circuit 614) to the feed stream 600*c* to avoid net flash export. This operational configuration could be desirable if electric motors are used to drive the compressors of system 660 and it is desirable to configure the system to be capable of processing more volatile feed streams that ethylene.

FIG. 3C shows operation of the system 660 with three simultaneous feeds: ethane (feed stream 600*a*), ethylene (feed stream 600*d*), and an ethane/propane mixture (feed stream 600*c*). In this operational configuration, temperatures of both the ethane and ethane/propane mixture products are kept near bubble point in their respective storage tanks 634*a*, 634*c* using bypass circuits 622*a*, 622*c*. In these embodiment, at least some of the ethylene flash stream 611*d* is recycled via recycle circuit 614. The temperature of the cooled feed streams at the cold end of the MCHE 650 is preferably between the bubble points of ethane and ethylene.

EXAMPLES

The following are exemplary embodiments of the invention with the data based on simulations of an SMR process similar to embodiment shown in FIG. 1. Cases using multiple feeds or producing LNG, are run in rating mode. They are designed to produce 2.5 MTPA of ethane product by using four feed circuits. Table 1 provides a list of the operating regimes and resulting production rates for a liquefaction plant able to liquefy ethane, ethane-propane mixture, ethylene, propane, and natural gas.

TABLE 1

Operating regimes and resulting production of the liquefaction unit.

| Name | Ethane | E/P Mix (blend 81/19 Ethane Propane) | Ethylene | Propane | Natural Gas |
|---|---|---|---|---|---|
| Example 1 - Design Case | 2.25 MTPA | | | | |

TABLE 1-continued

Operating regimes and resulting production of the liquefaction unit.

| Name | Ethane | E/P Mix (blend 81/19 Ethane Propane) | Ethylene | Propane | Natural Gas |
|---|---|---|---|---|---|
| Example 2 - Rating Case | 1.25 MTPA | ≤0.625 MTPA | ≤0.625 MTPA | | |
| Example 3 A&B - Rating Case | | | | | ≥0.4 MTPA |

Example 1

In Example 1, only ethane is processed. This example is used to set the sizing of critical equipment, such as the MCHE 150 and refrigeration compressor C1. In this example, ethane enters the MCHE 150 at 30 degrees Celsius and 75 bar and is cooled to −124.5 degrees Celsius. Feed and product rates and compositions are specified in Table 2 below.

TABLE 2

| Name | Ethane Feed | Ethane Product |
|---|---|---|
| Flowrate, kg-mol/hr | 11271 | 10524 |
| Component, mol % | | |
| Methane | 4.65 | 1.47 |
| Ethane | 92.28 | 95.37 |
| Ethylene | 1.13 | 1.10 |
| Propane | 1.87 | 2.00 |
| Heavier HCs | 0.00 | 0.00 |
| CO2 | 0.07 | 0.06 |
| Total | 100.00 | 100.00 |
| Feed bypass (%) | 0 | 1 |

The low-pressure gaseous MR stream 140 has a flow rate of 17448 kg moles per hour. The MR has the composition shown in Table 3 and leaves the MCHE 150 at a temperature close to ambient temperature, for example, 38.3 degrees Celsius. The MR is compressed the compressor C1 from 8.0 bar to 49.6 bar, cooled by the high-pressure aftercooler 156 to 54.0 degrees Celsius, then separated in the phase separator 158 into the high-pressure vapor MR stream 142 and the high-pressure liquid MR stream 143.

TABLE 3

| Component, mol % | |
|---|---|
| Methane | 21.11 |
| Ethane | 43.45 |
| Butanes | 35.44 |
| Total | 100.00 |

Example 2

For Example 2, pretreated feed streams of ethane, ethylene, and ethane/propane mix enter the MCHE 150 unit at 30 degrees Celsius and 75 bar and are cooled to −154 degrees Celsius. In this example, process flow is as shown in FIG. 6. Feed and product rates and compositions are specified in Table 4 and Table 6, respectively, below. Table 5 also show normal bubble points of mixtures.

TABLE 4

| Feed composition and rate | | | |
|---|---|---|---|
| Name | Ethane | Ethylene | Ethane/Propane |
| Flowrate, kg-mol/hr | 5641 | 1630 | 2171 |
| Component, mol % | | | |
| Methane | 4.65 | 0.01 | 3.91 |
| Ethane | 92.28 | 0.04 | 75.65 |
| Ethylene | 1.13 | 99.95 | 0.00 |
| Propane | 1.87 | 0.00 | 17.75 |
| Heavier HCs | 0.00 | 0.00 | 2.62 |
| CO2 | 0.07 | 0.00 | 0.07 |
| Total | 100.00 | 100.00 | 100.00 |
| Feed bypass, % | 10.1 | 0.0 | 14.4 |

TABLE 5

| Product composition and rate | | | |
|---|---|---|---|
| Name | Ethane | Ethylene | Ethane/Propane |
| Flowrate, kg-mol/hr | 5257 | 1630 | 1859 |
| Component, mol % | | | |
| Methane | 1.24 | 0.01 | 0.36 |
| Ethane | 95.60 | 0.04 | 76.08 |
| Ethylene | 1.10 | 99.95 | 0.00 |
| Propane | 2.00 | 0.00 | 20.47 |
| Heavier HCs | 0.00 | 0.00 | 3.06 |
| CO2 | 0.06 | 0.00 | 0.03 |
| Total | 100.00 | 100.00 | 100.00 |
| Normal Bubble Point, C. | −94.5 | −102.4 | −85.0 |

The low-pressure gaseous MR stream 140 has a flow rate of 17493 kg moles per hour. The MR has the composition shown in Table 6, leaves the MCHE 150 at close to ambient temperature, for example, 38.9 degrees Celsius, is compressed in the MR Compressor C1 from 8.0 bar to 50.8 bar, and cooled by the high-pressure aftercooler 156 to 54.0 degrees Celsius. The rest of the process of Example 2 is identical to Example 1.

TABLE 6

| Mixed Refrigerant Composition | |
|---|---|
| Component, mol % | |
| Methane | 28.48 |
| Ethane | 36.37 |
| Butanes | 35.15 |
| Total | 100.00 |

Example 3

For Examples 3A & 3B, pretreated natural gas feed stream enters the MCHE at 30 degrees Celsius and 75 bar. Example 3A used the configuration of FIG. 2, but without the first feed stream 300. The flow scheme includes an exchanger which cools a slipstream of hot natural gas feed against the cold end flash gas. The end flash gas and the vapor from the storage tank are recycled and mixed with the natural gas feed. The need to recycle may be necessary at facilities which use electric motors to power the refrigerant compressors, and thus do not have a need or have a reduced need for fuel gas. LNG is cooled to −150.4 degrees Celsius. Example 3B uses the configuration shown in FIG. 3 but without the first feed stream 300. By adding the nitrogen expander cycle, it is possible to partially shift the load from the existing mixed refrigerant compressors to the nitrogen expander cycle. For this scheme, the LNG is cooled to −109.7 degrees Celsius in the MCHE 150 and to −164.9 degrees Celsius by the nitrogen expander cycle. The latter temperature eliminates vaporization in the storage tank. Examples 3A and 3B use the feed rate and composition specified in Table 7 below and produce the product composition and feed rates shown in Table 8 below.

TABLE 7

| Feed composition and rates | | |
|---|---|---|
| Name | Example 3A Natural Gas | Example 3B Natural Gas |
| Flowrate, kg-mol/hr | 5641 | 1630 |
| Component, mol % | | |
| Nitrogen | 0.89 | |
| Methane | 88.81 | |
| Ethane | 8.22 | |
| Ethylene | 0.00 | |
| Propane | 1.39 | |
| Heavier HCs | 0.69 | |
| CO2 | 50 ppm | |
| Total | 100.00 | |
| Feed bypass, % | 0 | 0 |

TABLE 8

| Product composition and rates | | |
|---|---|---|
| Name | Example 3A Natural Gas | Example 3B Natural Gas |
| Flowrate, kg-mol/hr | 3548 | 6311 |
| Component, mol % | | |
| Nitrogen | 1.00 | 0.89 |
| Methane | 88.75 | 88.81 |
| Ethane | 8.18 | 8.22 |
| Ethylene | 0.00 | 0.00 |
| Propane | 1.38 | 1.39 |
| Heavier HCs | 0.69 | 0.69 |
| CO2 | 45 ppm | 50 ppm |
| Total | 100.00 | 100.00 |

MR compositions for Examples 3A & 3B are shown below in Table 9. For Example 3A, the low-pressure gaseous MR stream 240 has a flow rate of 12066 kg moles per hour. The MR leaves the MCHE 250 at close to ambient temperature, for example, 45.1 degrees Celsius, is compressed from 5.4 bar to 54.9 bar, and cooled by the aftercooler 256 to 54.0 degrees Celsius. For Example 3B, the low-pressure gaseous MR 340 has a flow rate of 14333 kg moles per hour. It leaves the MCHE 350 at close to ambient temperature, for example, 41.0 degrees Celsius, is compressed from 6.7 bar to 49.2 bar, and cooled by the high-pressure aftercooler 256 to 54.0 degrees Celsius.

TABLE 9

| Mixed Refrigerant Compositions | | |
|---|---|---|
| Component, mol % | Example 3A | Example 3B |
| Nitrogen | 8.83 | 0.00 |
| Methane | 29.76 | 30.45 |
| Ethane | 35.57 | 37.76 |
| Propane | 0.00 | 0.00 |
| Butanes | 21.89 | 31.79 |
| Pentanes | 3.95 | 0.00 |
| Total | 100.00 | 100.00 |

The rest of the processes of Examples 3A and 3B are the same as Example 1.

The invention claimed is:

1. A method for cooling and liquefying at least two feed streams in a coil-wound heat exchanger, the method comprising:

(a) introducing that at least two feed streams into a warm end of the coil-wound heat exchanger, the at least two feed streams comprising a first feed stream having a first normal bubble point and a second feed stream having a second normal bubble point that is lower than the first normal bubble point;

(b) cooling by indirect heat exchange in the con-wound heat exchanger at least a first portion of each of the first feed stream and the second feed stream against a refrigerant to form at least two cooled feed streams comprising a first cooled feed stream and a second cooled feed stream;

(c) withdrawing the at least two cooled feed streams from a cold end of the coil-would heat exchanger at substantially the same withdrawal temperature;

(d) providing at least two product streams, each of the at least two product streams being downstream from and in fluid flow communication with one of the at least two cooled feed streams, each of the at least two product streams being maintained within a predetermined product stream temperature range of a predetermined product stream temperature, the at least two product streams comprising a first product stream and a second product stream, the predetermined product stream temperature for the first product stream being the first predetermined product stream temperature and the predetermined product stream temperature of the second product stream being the second predetermined product stream temperature;

(e) withdrawing a first bypass stream from the first feed stream upstream from the cold end of the coil-wound heat exchanger; and (f) forming the first product stream by mixing the first cooled feed stream with the first bypass stream, the first predetermined product stream temperature being warmer than the withdrawal temperature of the first cooled feed stream.

2. The method of claim 1, wherein each of the at least two feed streams comprises a hydrocarbon fluid.

3. The method of claim 1, wherein step (e) comprises:

(e) withdrawing a first bypass stream from the first feed stream upstream from the warm end of the coil-wound heat exchanger.

4. The method of claim 1, further comprising:

(g) phase separating the second cooled feed stream into a second flash vapor stream and the second product stream, the predetermined product stream temperature of the second product stream being lower than the withdrawal temperature of the second cooled feed stream.

5. The method of claim 4, further comprising:

(h) compressing and cooling the second flash vapor stream to form a compressed second flash gas stream; and (i) mixing the compressed second flash vapor stream with the second feed stream upstream from the coil-wound heat exchanger.

6. The method of claim 5, further comprising:

(j) warming the second flash vapor stream by indirect heat exchange against the first bypass stream.

7. The method of claim 1, further comprising:

(k) storing the second product stream in a second storage tank at a second storage pressure;

wherein the predetermined product stream temperature of the second product stream is a temperature at which no more than 10 mole % of the second product stream vaporizes at the second storage pressure.

8. The method of claim 1, wherein the at least two feed streams further comprise a third feed stream having third volatility that is higher than the first volatility and lower than the second volatility, the at least two cooled feed streams further comprise a third cooled feed stream, the at least two product streams further comprise a third product stream.

9. The method of claim 8, wherein step (d) further comprises providing the third product stream having a predetermined product stream temperature that is the same as the withdrawal temperature of the third cooled feed stream.

10. The method of claim 1, further comprising:

(l) separating impurities from the second feed stream downstream from the second cooled feed stream in a phase separator to produce a second vapor stream containing the impurities and the second product stream.

11. The method of claim 1, wherein the predetermined product stream temperature range for each of the at least two product streams is 4 degrees C.

* * * * *